US012575679B2

(12) United States Patent
Mainridge

(10) Patent No.: US 12,575,679 B2
(45) Date of Patent: Mar. 17, 2026

(54) HEADREST FOR USE WITH A LOUNGE CHAIR

(71) Applicant: Amity Mainridge, Seminole, FL (US)

(72) Inventor: Amity Mainridge, Seminole, FL (US)

( * ) Notice: Subject to any disclaimer, the term of this patent is extended or adjusted under 35 U.S.C. 154(b) by 151 days.

(21) Appl. No.: 18/621,173

(22) Filed: Mar. 29, 2024

(65) Prior Publication Data

US 2024/0324782 A1 Oct. 3, 2024

Related U.S. Application Data

(60) Provisional application No. 63/493,347, filed on Mar. 31, 2023.

(51) Int. Cl.
*A47C 7/38* (2006.01)
*A47C 1/14* (2006.01)

(52) U.S. Cl.
CPC ..... *A47C 7/383* (2013.01); *A47C 1/143* (2013.01)

(58) Field of Classification Search
CPC .. A47C 7/383; A47C 7/38; A47C 1/14; A47C 1/143; A61G 13/121
See application file for complete search history.

(56) References Cited

U.S. PATENT DOCUMENTS

| | | | | | |
|---|---|---|---|---|---|
| 5,121,969 | A * | 6/1992 | Schroeder | A47C 7/38 | 297/410 |
| 5,466,039 | A * | 11/1995 | Umbrianna | A47C 1/143 | 297/115 |
| 6,042,184 | A * | 3/2000 | Kofoed | A47C 20/026 | 297/391 |
| 6,397,414 | B1 * | 6/2002 | Lloyd | A61G 13/12 | 5/643 |
| 8,668,268 | B1 * | 3/2014 | Cormack | A47C 1/143 | 297/354.13 |
| 12,208,042 | B2 * | 1/2025 | Garfoot | A61G 13/121 | |
| 2006/0290195 | A1 * | 12/2006 | Roleder | A61G 7/072 | 297/397 |
| 2014/0346834 | A1 * | 11/2014 | Skursky | A47C 1/024 | 297/397 |

* cited by examiner

*Primary Examiner* — Tye William Abell
(74) *Attorney, Agent, or Firm* — Lewellyn Law, PLLC; Stephen Lewellyn

(57) ABSTRACT

A headrest for supporting a person's head on a lounge chair is provided. The headrest is removably attachable to a chair cross-support that extends along the width of the chair for hanging over the end of the chair. The headrest may have a rigid support plate having a support face opening. The headrest may further have a cushion having a cushion face opening, with the cushion attached to a top of the support with the cushion face opening aligned with the support face opening. A pair of clamps may be spaced apart on the rigid support plate, each clamp configured to receive and clamp the cross-support with the cross support extending through each clamp to removably attach the headrest to the chair in a cantilever fashion.

20 Claims, 5 Drawing Sheets

HEADREST FOR USE WITH A LOUNGE CHAIR

CROSS-REFERENCE TO RELATED APPLICATIONS

This application claims the benefit of U.S. Application Ser. No. 63/493,347, filed Mar. 31, 2023, the entirety of which is incorporated herein by reference.

FIELD OF THE INVENTION

The present disclosure relates to headrests and, more particularly, to a headrest for use with lounge chairs and the like.

BACKGROUND OF THE INVENTION

Lying face down on a lounge chair requires a person to turn his or her head to one side. Staying in this prone position for extended periods can be uncomfortable to most people because it confines the arms, shoulders, and head of the person and there is limited support to the head and neck.

There exist head supports for lounge chairs that attempt to solve the problem of lying in a face-down, prone position on a lounge chair. While these existing head supports serve their respective objectives, a need remains for a new headrest for lounge chairs and the like.

SUMMARY OF THE INVENTION

Embodiments of the invention provide a headrest for use with a lounge chair or the like that allows a user to comfortably lay in a face-down position on the lounge chair.

Embodiments of the invention also provide a headrest for use with a lounge chair or the like that is simple to use and can be used with many different lounge chair constructions.

Embodiments of the invention also provide a headrest for use with a lounge chair or the like that allows a user, while in the face-down position, to read and/or drink a beverage via a straw that is placed below the user's face.

In an aspect, a headrest for attachment to a chaise lounge chair that has a cross-support at an end of the chair that extending along a width of the chair is provided. The headrest may have a rigid support plate having a support face opening. The headrest may further have a cushion having a cushion face opening, with the cushion attached to a top of the support with the cushion face opening aligned with the support face opening. A pair of clamps may be spaced apart on the rigid support plate, each clamp configured to receive and clamp the cross-support with the cross support extending through each clamp to removably attach the headrest to the chair in a cantilever fashion.

In an aspect, the rigid support plate may be U-shaped. In an aspect, the cushion may be U-shaped. In an aspect, the cushion may be attached to a top of the rigid support plate.

In an aspect, each clamp may have a channel that is configured to receive the chair cross-support therethrough.

In an aspect, the rigid support may have a pair of laterally spaced legs and wherein one clamp of the pair of clamps is attached to a leg.

In an aspect, a headrest for attachment to a chaise lounge chair that has a cross-support at an end of the chair that extends along a width of the chair is provided. The headrest may have a rigid support plate that may be U-shaped and has a support face opening defined between a pair of latterly spaced side portions that each terminate at a free end and which are connected at their opposite ends by a forehead portion. The headrest may have a cushion that is U-shaped and has a cushion face opening and the cushion may be attached to a top surface of the rigid support plate with the cushion face opening and the support face opening aligned. A pair of clamps may be provided with one attached to each free end to be spaced apart on the rigid support plate. Each clamp may be configured to receive and clamp the cross-support with the cross support extending through each clamp to removably attach the headrest to the chair in a cantilever fashion.

In an aspect, each clamp has a channel that is configured to receive the cross-support therethrough.

In an aspect, the channel may have length and a slot extending the length and providing an opening through which the cross-support may be passed for insertion into the channel.

In an aspect, each clamp may have a first part and a second part. The first part of each clamp may be attached to a respective free end of the rigid support plate and extend therefrom a length and terminates at an end. The first part may further have a transversely extending first arcuate portion. The second part may be pivotally connected to the rigid support plate at the respective free end. The second part may have opposite first and second ends and may have a transversely extending second arcuate portion approximate the first end. The second arcuate portion corresponds with the first arcuate portion to define a channel space therebetween that is configured to receive the cross-support therethrough.

Numerous additional objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings.

DETAILED DESCRIPTION

Figure 1:
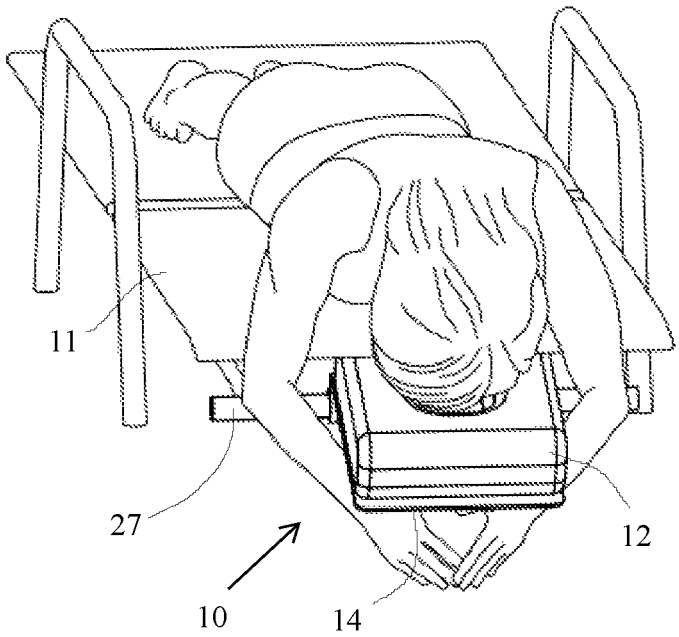
FIG. 1 is a perspective view of a headrest that is constructed in accordance with the principles of an embodiment of the invention, the headrest shown in use in connection with a lounge chair and a person laying on the lounge chair.
Figure 2:
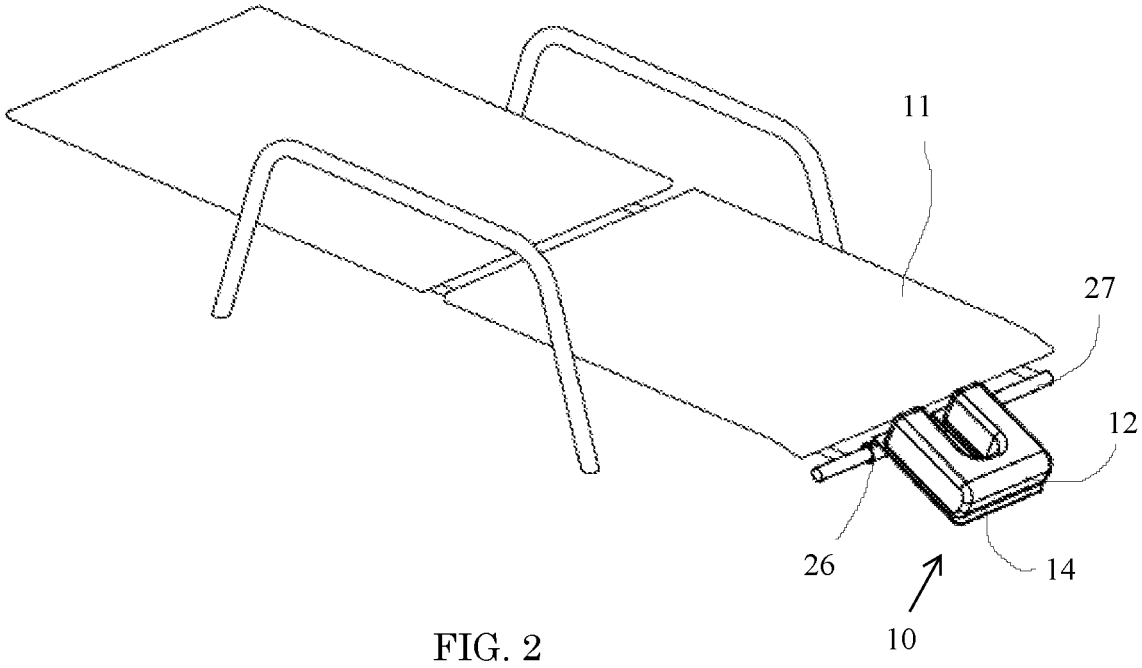
FIG. 2 is a perspective view of a headrest that is constructed in accordance with the principles of an embodiment of the invention, the headrest shown in use in connection with a lounge chair.
Figure 3:
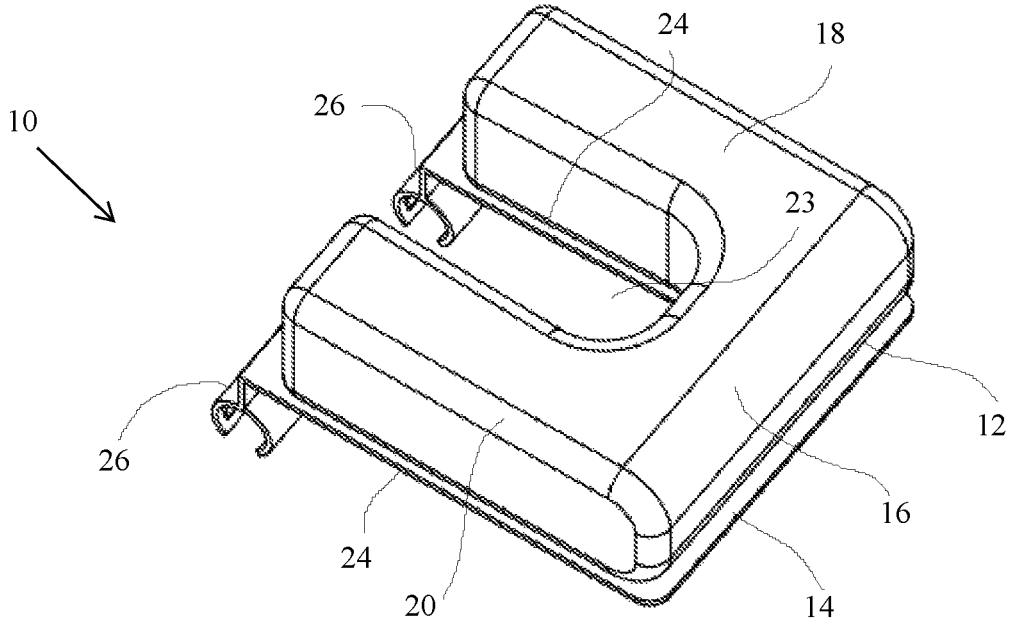
FIG. 3 is a top perspective view of a headrest that is constructed in accordance with the principles of an embodiment of the invention.
Figure 4:
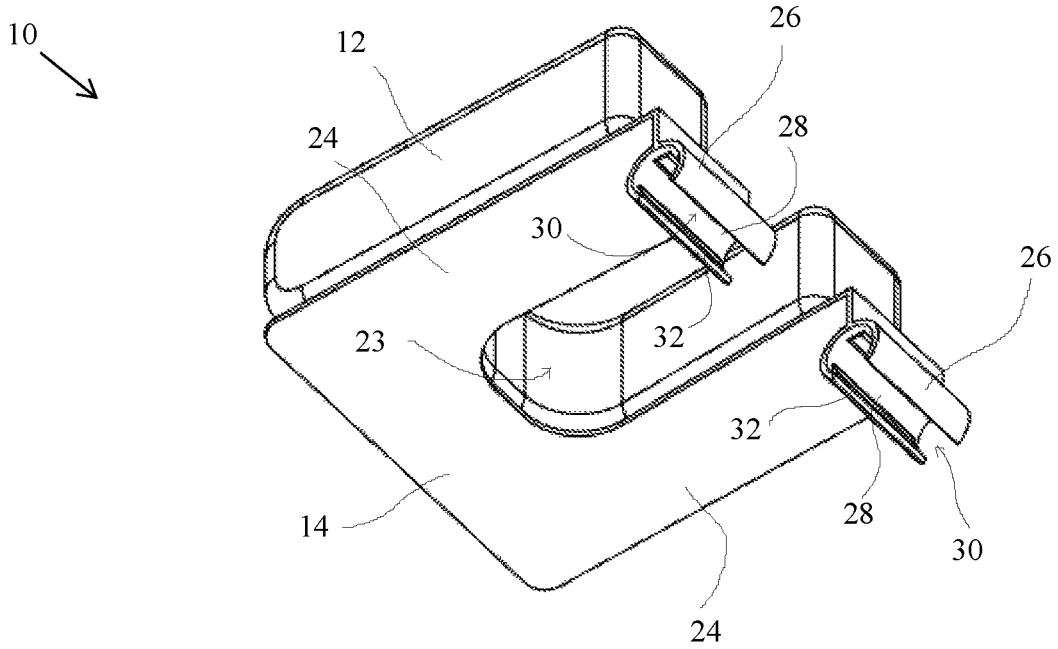
FIG. 4 is a bottom perspective view of a headrest that is constructed in accordance with the principles of an embodiment of the invention.
Figure 5:
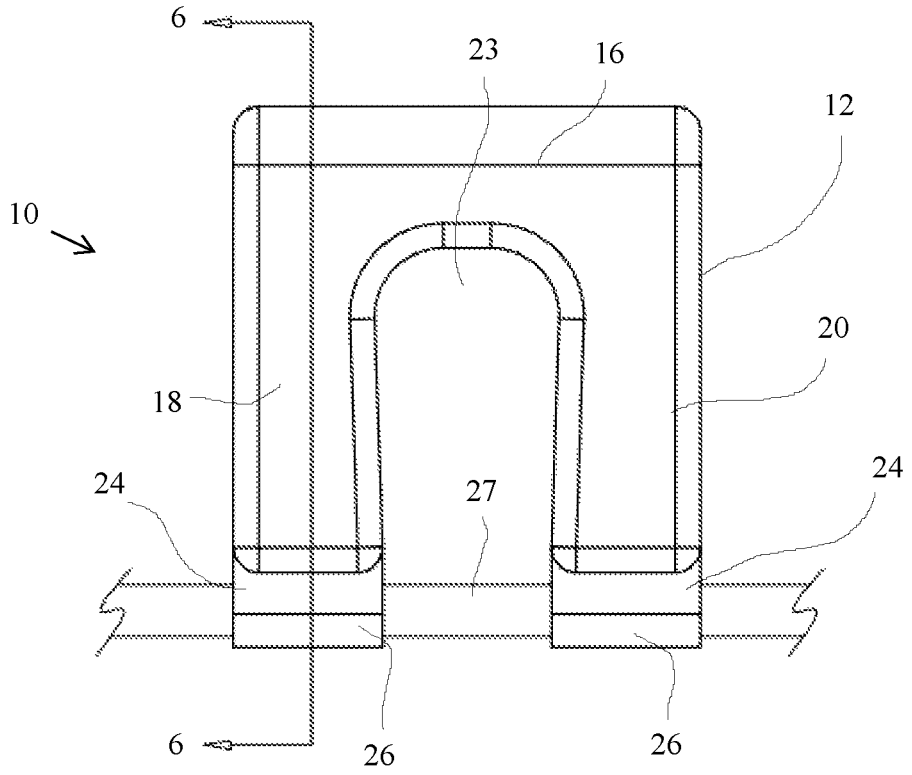
FIG. 5 is a top plan view of a headrest that is constructed in accordance with the principles of an embodiment of the invention, showing the head rest attached to a cross support of a lounge chair.
Figure 6:
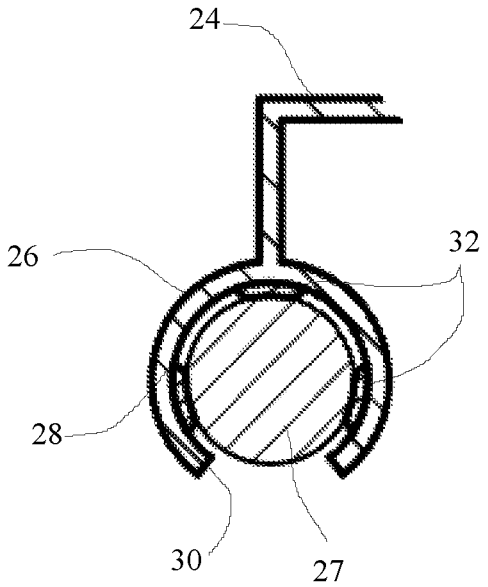
FIG. 6 is a cross-sectional view taken along line 6-6 in FIG. 5.

The following detailed description of embodiments of the invention references the accompanying drawings. The embodiments are intended to describe aspects of the invention in sufficient detail to enable those skilled in the art to practice the invention.

Turning now to FIGS. 1-6 of the drawings, headrest 10 which is constructed in accordance with an embodiment of the invention is illustrated. Headrest 10 is configured to be used in connection with a lounge chair 11 or a similar type of chair to comfortably support a user's head when laying a face-down position on the chair.

In the representatively illustrated embodiment, the headrest 10 includes a headrest cushion 12 and a headrest frame 14. Headrest cushion 12 is attached to the top surface of the headrest frame 14 and the headrest frame is configured to provide rigid support to the headrest cushion. As shown, the headrest cushion 12 is generally U-shaped having an upper forehead portion 16 and laterally spaced side portions 18 and 20 extending from the forehead portion. The forehead portion 16 and the side portions 18 and 20 define a face opening 23 therebetween in which a user's face is positioned while the user's head is supported by the forehead and side portions of the headrest cushion 12. Face opening 23 allows access to a user's face when using the headrest so that a user may read a book for example, or even drink a beverage using a straw while lying in the face-down position on the chair.

The headrest frame 14 is shaped to compliment the U-Shaped headrest cushion 12 and is likewise also generally U-shaped. As representatively shown, the headrest frame has a generally planar U-shaped cushion supporting plate 22 and a corresponding face opening that aligns with the face opening 23 of the headrest cushion 12.

The headrest frame 14 has a pair of laterally spaced legs 24 that are each connected to the supporting plate 22 at one end and include a clamp 26 at the opposite end. Clamps 26 are configured to removably attach to a cross-support of the chair which is located toward the end of the chair and thereby removably attach the headrest 10 to the chair at a position approximate the end of the chair.

As representatively shown, clamps 26 are configured to frictionally engage a cross-support of the chair. Each clamp includes channel 28 that is non-continuous about its periphery and has a slot 30 that extends along the length of the channel which provides for an opening to insert the cross-support of the chair into the channel. The legs 24 of the headrest frame 14 are attached to its respective clamp 26 along the periphery of the clamp and at a position opposite of slot 30.

As further shown, one or more rubber-like pads 32 can be disposed along the interior surface of channel 28 to provide increased frictional contact with the cross-support of the chair when the cross-support is received in the channel. While not shown a rubberized coating could also be disposed along the interior surface of channel 28 to provide increased frictional contact with the cross-support of the chair when the cross-support is received in the channel.

In use the headrest 10 is attached to a lounge chair or the like by attaching the clamps 26 of the headrest frame 14 to a cross support 27 of the lounge chair that is located near an end of the chair in which the user wants to lay face down. Once the headrest 10 is attached to the chair, a user may lay face down on the chair, positioning his or her face in the face opening 22 and with the head comfortably supported by the head cushion 12.

Figure 7:
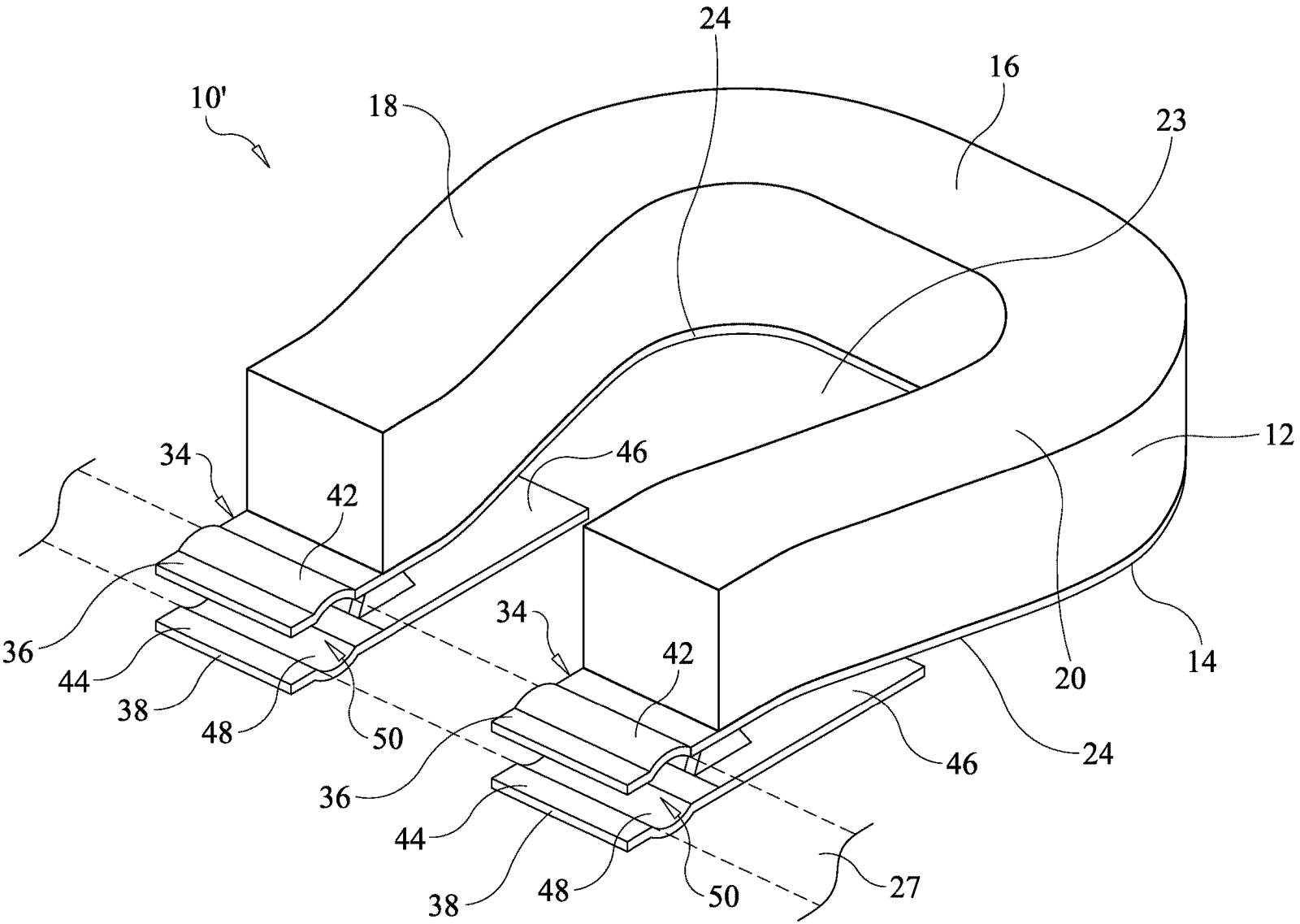
FIG. 7 is a first perspective view of a headrest that is constructed in accordance with another embodiment of the invention.
Figure 8:
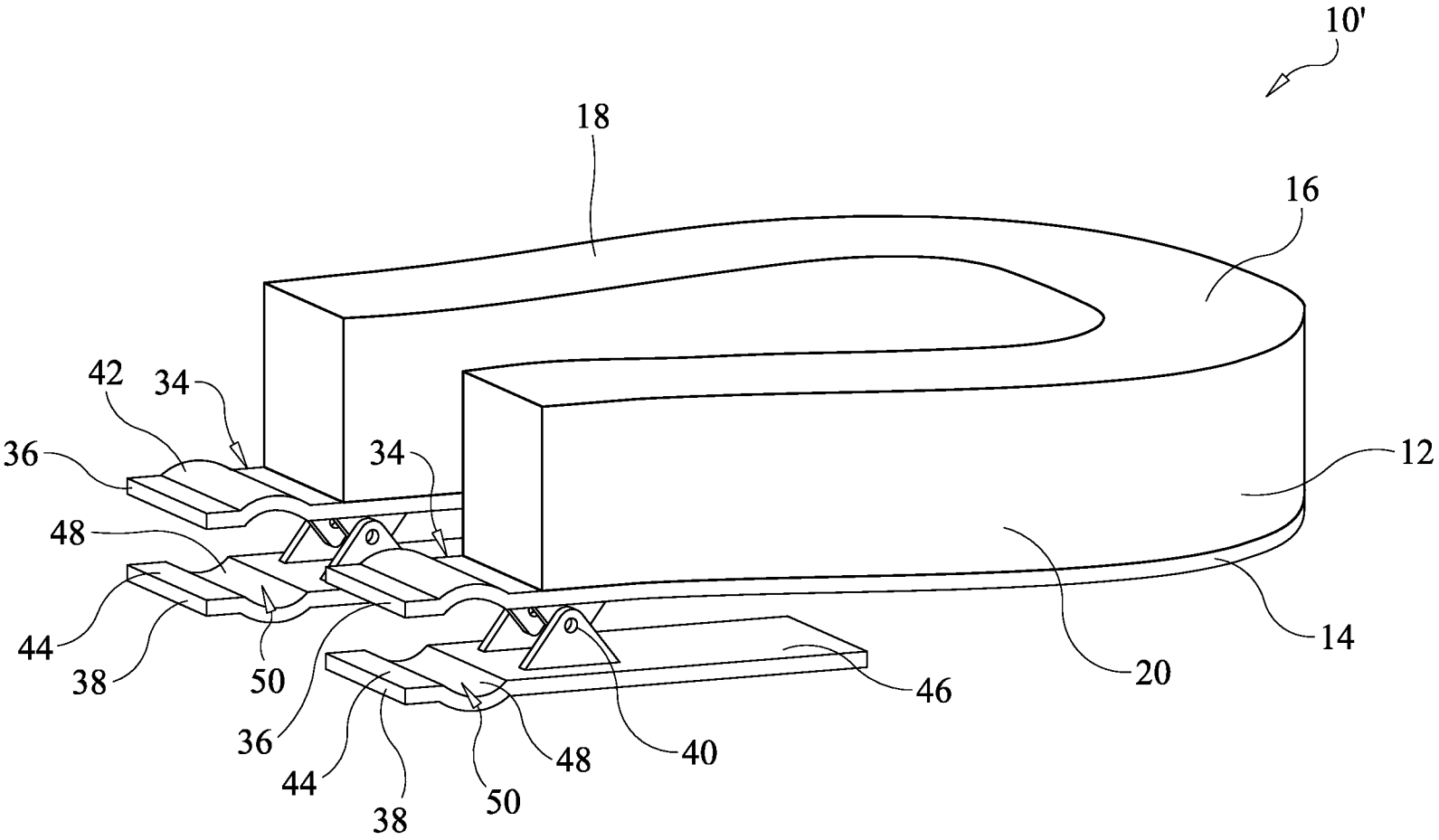
FIG. 8 is a second perspective view of the headrest of FIG. 7.

In FIGS. 7 and 8, there is shown a headrest 10' according to an alternative embodiment. Headrest 10' has a similar construction to headrest 10 and like reference numbers refer to similar or the same elements. The main difference between headrest 10 and headrest 10' is the clamps used to attach the headrests to a cross support of a lounge chair. In the illustrated embodiment, headrest 10' has two clamps 34 which replace clamps 26.

As shown, each clamp 34 has the first part 36 and the second part 38. The first part 36 may be formed integral with the support plate 22 and terminate at a free end. The first part 36 may also have a transversely extending curved bend or arcuate portion 42. The second part 38 is pivotally connected to the support plate at coupling 40. The second part 38 has opposite ends 44 and 46 and is generally elongated and planar shaped. The second part 38 may have a transversely extending curved bend or arcuate portion 48 appointment end 44 that corresponds with the arcuate portion 42 of the first part 36.

The first and second parts 36 and 38 are arranged with their arcuate portions 42 and 48 facing one another with the curvatures facing in opposite directions to create a semi-circular channel 50 between the parts. Channel 50 is configured to receive a cross support of a lounge chair with the cross support extending lengthwise through the space.

The second part 38 may be spring biased to pivot at coupling 40 and move end 44 in a direction toward the first part 36. In operation, a user may depress end 46 which causes the opposite end 44 to move in a direction away from the first part 36, thereby opening the clamp to receive a cross support of a lounge chair in channel 50 and secure the headrest 10' to the lounge chair. While not shown, rubberized coating, pads 32, or other means could be provided on clamps 34 to prevent them from rotating about the lounge chair cross support.

It will be appreciated by persons skilled in the art that the present embodiment is not limited to what has been particularly shown and described hereinabove. A variety of modifications and variations are possible in view of the above teachings without departing from the scope of the disclosure. For example, while not shown, legs 24 could be configured such that their lengths can be adjusted to selectively position the headrest cushion 12 at a desired position from the end of the chair to which the headrest 10 is attached. Thus, it is intended by the appended claims to cover all such features and advantages of the invention which fall within the true spirit and scope of the disclosure.

What is claimed is:

1. A headrest for attachment to a chaise lounge chair that has a cross-support at an end of the chair that extends along a width of the chair, the headrest comprising:

a rigid support plate having a support face opening;

a cushion having a cushion face opening, the cushion attached to a top of the support with the cushion face opening aligned with the support face opening;

a pair of clamps, each attached to and spaced apart on the rigid support plate, each clamp configured to receive and clamp the cross-support with the cross-support extending through each clamp to removably attach the headrest to the chair in a cantilever fashion.

2. The headrest of claim 1, wherein the rigid support plate is U-shaped.

3. The headrest of claim 1, wherein the cushion is U-shaped.

4. The headrest of claim 1, wherein each clamp has a channel that is configured to receive the cross-support therethrough.

5. The headrest of claim 1, wherein the rigid support has a pair of laterally spaced legs and wherein one clamp of the pair of clamps is attached to a leg.

6. The headrest of claim 1, wherein the cushion is attached to a top of the rigid support plate.

7. The headrest of claim 1, wherein at least one clamp of the pair of clamps has a channel and a slot extending a length of the channel which provides an opening for inserting the cross-support into the channel when the clamp is attached to the cross-support.

8. The headrest of claim 7, further comprising one or more friction pads disposed along an interior surface of the channel to provide a friction contact between the clamp and the cross-member.

9. A headrest for attachment to a chaise lounge chair that has a cross-support at an end of the chair that extends along a width of the chair, the headrest comprising:

a rigid support plate, the rigid support plate is U-shaped and has a support face opening defined between a pair of latterly spaced side portions that each terminate at a free end and which are connected at their opposite ends by a forehead portion;

a cushion, the cushion is U-shaped and has cushion face opening, the cushion is attached to a top surface of the rigid support plate with the cushion face opening and the support face opening aligned;

a pair of clamps, one attached to each free end to be spaced apart on the rigid support plate, each clamp configured to receive and clamp the cross-support with the cross-support extending through each clamp to removably attach the headrest to the chair in a cantilever fashion.

10. The headrest of claim 9, wherein each clamp has a channel that is configured to receive the cross-support therethrough.

11. The headrest of claim 9, wherein the channel has a length and a slot extending the length and providing an opening through which the cross-support may be passed for insertion into the channel.

12. The headrest of claim 9, wherein each clamp comprises:

a first part and a second part;

the first part of each clamp is attached to a respective free end of the rigid support plate and extends therefrom a length and terminates at an end, the first part further having a transversely extending first arcuate portion; and the second part is pivotally connected to the rigid support plate at the respective free end, the second part having opposite first and second ends, the second part having a transversely extending second arcuate portion approximate the first end, the second arcuate portion corresponding with the first arcuate portion to define a channel space therebetween that is configured to receive the cross-support therethrough.

13. The headrest of claim 9, wherein at least one clamp of the pair of clamps has a channel and a slot extending a length of the channel which provides an opening for inserting the cross-support into the channel when the clamp is attached to the cross-support.

14. The headrest of claim 13, further comprising one or more friction pads disposed along an interior surface of the channel to provide a friction contact between the clamp and the cross-member.

15. In a combination a chaise lounge chair and a headrest removably attached to the chaise lounge chair, the combination comprising:

the chaise lounge chair comprising a cross-support at an end of the chair that extends across a width of the chair;

the headrest comprising:

a rigid support plate having a support face opening;

a cushion having a cushion face opening, the cushion attached to a top of the support with the cushion face opening aligned with the support face opening;

a pair of clamps, each attached to and spaced apart on the rigid support plate, each clamp configured to receive and clamp the cross-support with the cross-support extending through each clamp to removably attach the headrest to the chair in a cantilever fashion.

16. The combination of claim 15, wherein the rigid support plate is U-shaped.

17. The headrest of claim 15, wherein the cushion is U-shaped.

18. The headrest of claim 15, wherein each clamp has a channel that is configured to receive the cross-support therethrough.

19. The headrest of claim 15, wherein the rigid support has a pair of laterally spaced legs and wherein one clamp of the pair of clamps is attached to a leg.

20. The headrest of claim 15, wherein the cushion is attached to a top of the rigid support plate.

* * * * *